US009456707B2

(12) United States Patent
Moody et al.

(10) Patent No.: US 9,456,707 B2
(45) Date of Patent: Oct. 4, 2016

(54) MERCHANDISER WITH POWER GENERATION USING AIR DIFFUSER

(71) Applicant: Hussmann Corporation, Bridgeton, MO (US)

(72) Inventors: Kevin A. Moody, West Covina, CA (US); Raymond P. Twohy, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 202 days.

(21) Appl. No.: 14/106,049

(22) Filed: Dec. 13, 2013

(65) Prior Publication Data

US 2015/0164243 A1 Jun. 18, 2015

(51) Int. Cl.
*A47F 3/04* (2006.01)

(52) U.S. Cl.
CPC ..... *A47F 3/0482* (2013.01); *A47F 3/0408* (2013.01)

(58) Field of Classification Search
CPC ..... A47F 3/04; A47F 3/0408; A47F 3/0482; A47F 3/0439; A47F 3/0443
USPC ..... 62/264; 362/133
See application file for complete search history.

(56) References Cited

U.S. PATENT DOCUMENTS 3,448,675 A 6/1969 Davies
3,944,840 A 3/1976 Troll
4,369,632 A * 1/1983 Abraham ..... A47F 3/0408 62/256
4,475,446 A * 10/1984 McCall ..... F24F 13/072 454/304
4,550,259 A 10/1985 Bertels
5,136,486 A 8/1992 Burkarth
6,191,496 B1 2/2001 Elder
2007/0018462 A1* 1/2007 Richards ..... F03D 3/002 290/55
2008/0061559 A1* 3/2008 Hirshberg ..... F03D 3/0454 290/55
2009/0244890 A1 10/2009 Pelken et al.
2011/0042952 A1* 2/2011 Ohya ..... F03D 1/04 290/52

FOREIGN PATENT DOCUMENTS

CN 101165987 4/2008

* cited by examiner

*Primary Examiner* — Len Tran
*Assistant Examiner* — Ana Vazquez
(74) *Attorney, Agent, or Firm* — Michael Best & Friedrich LLP

(57) ABSTRACT

A refrigerated merchandiser including a case that defines a product display area. The case has an air inlet located adjacent the product display area, an air outlet to discharge an airflow into the product display area, and a passageway fluidly connecting the air inlet to the air outlet to direct a conditioned airflow from the air outlet across the product display area and generally toward the air inlet. The merchandiser also includes an electrical component and a power generation system that has a power generation device in communication with the airflow to convert kinetic energy of the airflow into electrical energy to power the electrical component based on movement of the airflow.

19 Claims, 4 Drawing Sheets

MERCHANDISER WITH POWER GENERATION USING AIR DIFFUSER

BACKGROUND

The present invention relates to a refrigerated merchandiser, and more particularly, to a refrigerated merchandiser including a power generation system that uses airflow movement to generate power for one or more components in the refrigerated merchandiser.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors typically include one or more glass panels that allow a consumer to view the food products stored inside the case. Other merchandisers do not have doors, but utilize one or more air curtains directed across the product display area to separate the refrigerated environment of the product display area from the ambient environment surrounding the merchandiser.

Refrigerated merchandisers also often include one more electrical components, such as fans, light bulbs, etc. that are located within the refrigerated merchandisers and are powered by outside electrical sources. Over time, use of these electrical components results in high electrical costs.

SUMMARY

In one construction, the invention provides a refrigerated merchandiser that includes a case defining a product display area. The case has an air inlet located adjacent the product display area, an air outlet to discharge an airflow into the product display area, and a passageway fluidly connecting the air inlet to the air outlet to direct a conditioned airflow from the air outlet across the product display area and generally toward the air inlet. The merchandiser also includes an electrical component and a power generation system that has a power generation device in communication with the airflow to convert kinetic energy of the airflow into electrical energy to power the electrical component based on movement of the airflow.

In another construction, the refrigerated merchandiser also includes a light source coupled to the case and positioned to illuminate the product display area, a fan positioned in the passageway to generate the airflow, and a power generation system. The power generation system has a housing coupled to the case within the passageway, and an air diffuser and a generator disposed in the housing. The air diffuser has an opening to receive an airflow flowing through the passageway. The generator is in communication with the airflow to convert kinetic energy of the airflow into electrical energy to at least partially power at least one of the light source and the fan based on movement of the airflow within the passageway.

In another construction, the invention provides a method of powering an electrical component in a refrigerated merchandiser. The method includes directing an airflow through a passageway within the merchandiser that communicates air to an air outlet, and discharging the airflow through the air outlet to condition a product display area of the merchandiser. The method also includes directing the airflow through a generator, converting kinetic energy of the airflow into electrical energy in response to air passing through the generator, and at least partially powering an electrical component of the merchandiser via the electrical energy generated based on movement of the airflow.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
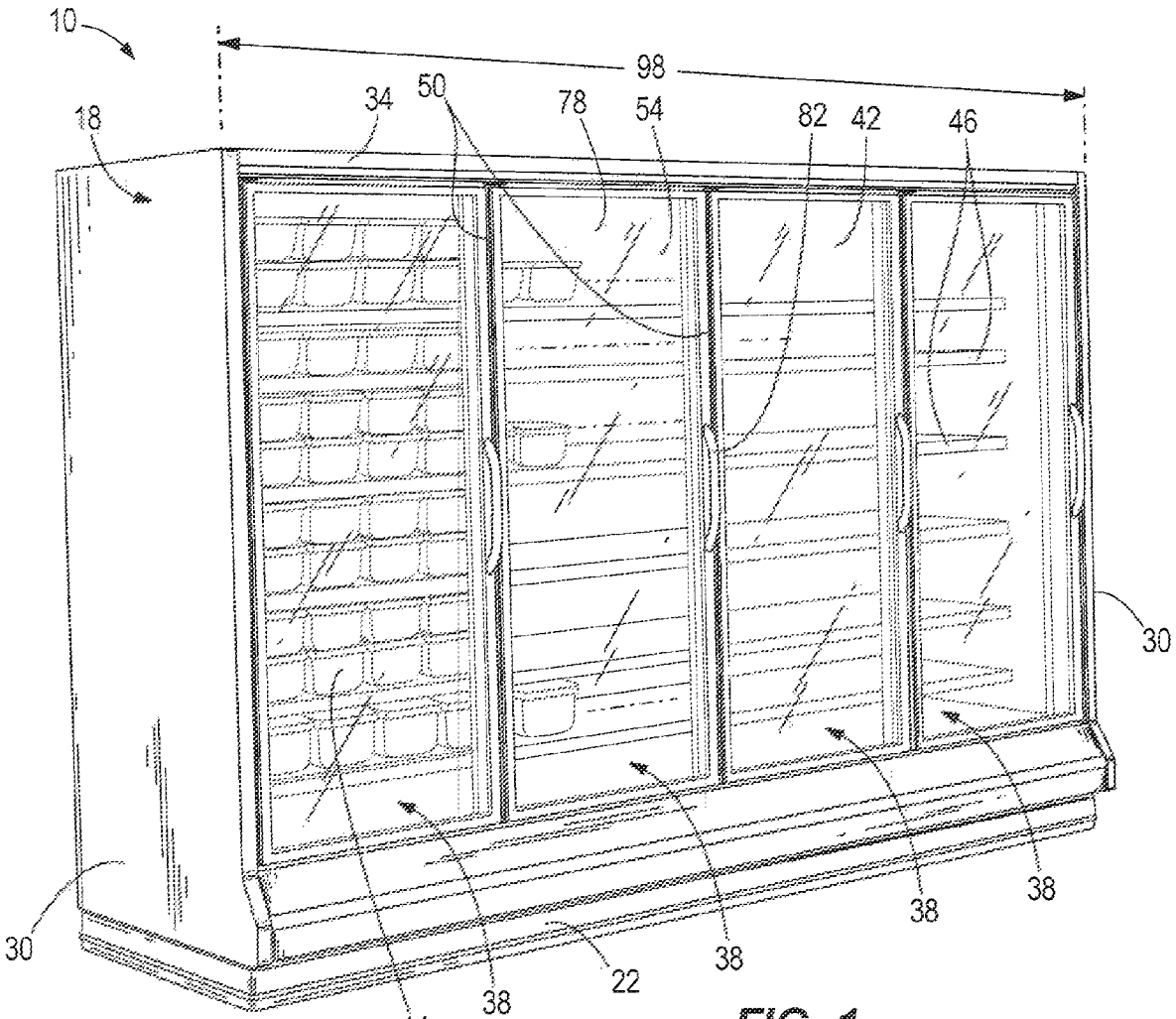
FIG. 1 is a front perspective view of a refrigerated merchandiser embodying the present invention.
Figure 2:
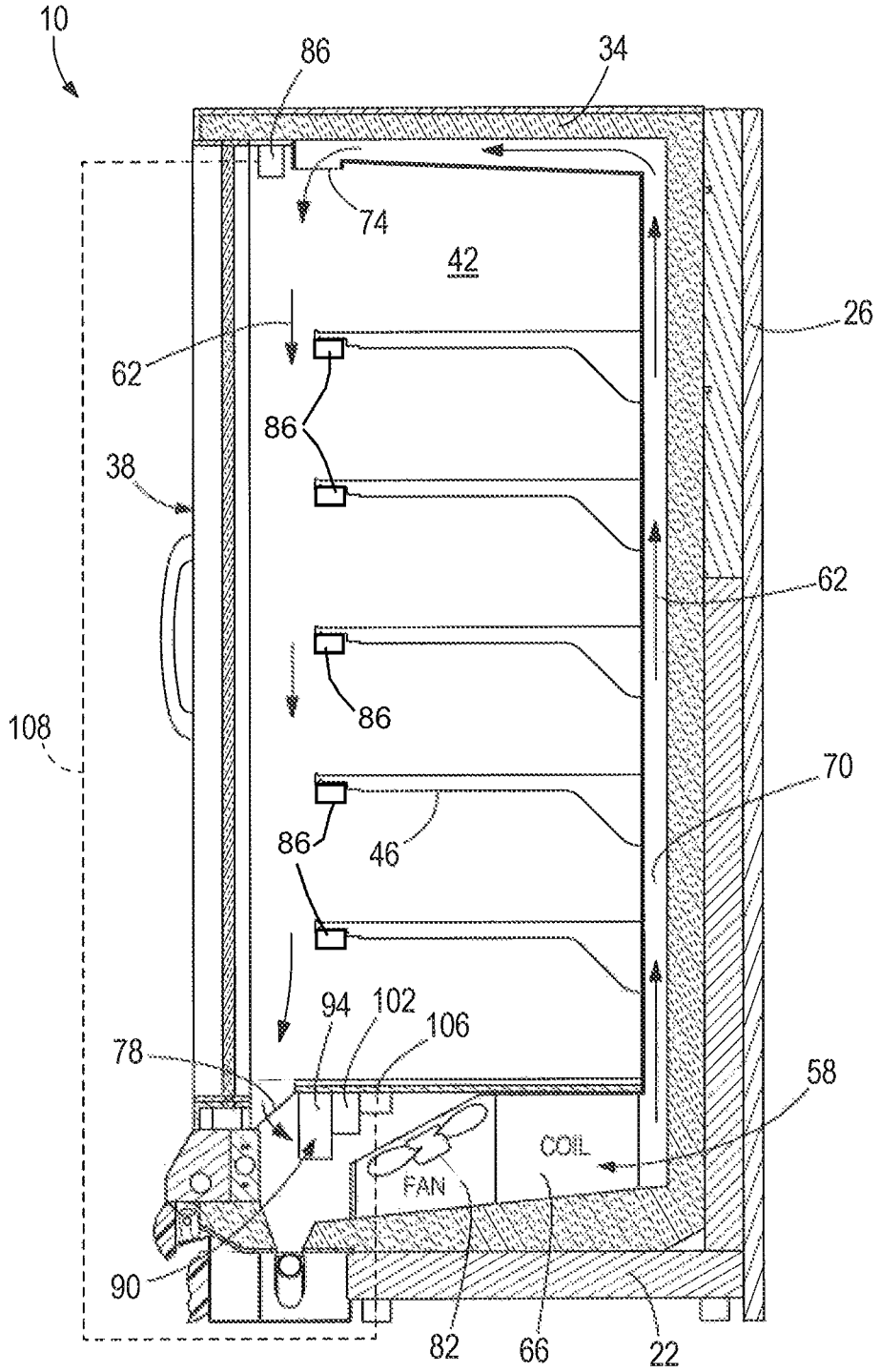
FIG. 2 is a schematic cross-section of the refrigerated merchandiser of FIG. 1, illustrating a power generation system.

FIGS. 1 and 2 show a refrigerated merchandiser 10 that may be located in a supermarket or a convenience store (not shown) for presenting fresh food, beverages, and other food product 14 to consumers. The illustrated merchandiser 10 is an upright merchandiser, although other types of merchandisers (e.g., horizontal merchandisers, etc.) fall within the scope of the invention. The merchandiser 10 includes a case 18 that has a base 22, a rear wall 26, side walls 30, a canopy 34, and a plurality of doors 38. The doors 38 are supported by the case 18, and permit access to the food product 14. The area partially enclosed by the base 22, rear wall 26, side walls 30, and the canopy 34 defines a product display area 42 that supports the food product 14 in the case 18. The food product 14 is displayed on racks or shelves 46 extending forwardly from the rear wall 26, and is accessible by consumers through the doors 38 adjacent the front of the case 18. As shown in FIG. 1, the food product 14 and the shelves 46 are visible behind the substantially transparent doors 38.

The case 18 also includes vertical mullions 50 that define openings 54 in communication with the product display area 42 to allow access to the food product 14. The mullions 50 are spaced horizontally along the case 18 to provide structural support for the case 18. Each mullion 50 is defined by a structural member that can be formed from a non-metallic or metallic material. The doors 38 are pivotally coupled to the casing 18 over the openings 54, and substantially enclose the product display area 42.

In the illustrated construction, the refrigerated merchandiser 10 includes four doors 38 separated by the mullions 50. In other constructions, the refrigerated merchandiser 10 may include fewer or more doors 38 depending on the size of the case 18. In yet other constructions, the refrigerated merchandiser 10 includes no doors 38 or mullions 50, and is instead an open refrigerated merchandiser 10.

Referring to FIG. 2, at least a portion of a refrigeration system 58 is in communication with case 18 to provide a refrigerated airflow (denoted by arrows 62) to the product display area 42. The refrigeration system 58 includes an evaporator 66 disposed in an air passageway 70 of the case 18, a compressor (not shown), and a condenser (not shown) connected in series with each other. As is known in the art, the evaporator 66 receives a saturated refrigerant that has passed through an expansion valve from the condenser. The saturated refrigerant is evaporated as it passes through the evaporator 66 as a result of absorbing heat from air passing over the evaporator. The absorption of heat by the refrigerant allows the temperature of the air to decrease as it passes over the evaporator 66. The heated or gaseous refrigerant then exits the evaporator 66 and is pumped back to the compressor for re-processing into the refrigeration system 58. The cooled airflow 62 exiting the evaporator 66 via heat exchange with the liquid refrigerant is directed through the air passageway 70 and is introduced into the product display area 42 as an air curtain that maintains the food product 14 at desired conditions.

The airflow 62 is directed downward through the product display area 42 out of an air outlet 74 toward the base 22, where at least some of the airflow 62 passes through an air inlet 78. As illustrated in FIG. 2, the airflow 62 flowing through the air inlet 78 is drawn into the air passageway 70 by a fan 82 located upstream of the evaporator 66. The air inlet 78 and the air outlet 74 are both located adjacent the product display area 42.

With continued reference to FIG. 2, the merchandiser 10 also includes light sources 86 disposed within the case 14 to illuminate the product display area 42. As illustrated, one light source 86 is coupled to the canopy 34 and located adjacent the door 38, and additional light sources 86 are coupled to the cantilevered end of each shelf 46. The illustrated light sources 86 are an LED light source, although the light sources 86 can include other types (and quantities) of light sources 86. Also, while the light sources 86, or additional light sources, can be located elsewhere in the case 14 to illuminate the product display area 42.

With reference to FIGS. 2-5, the merchandiser 10 further includes a power generation system 90 that provides power to at least one electrical component (e.g., the fan 82, the light source 86, etc.). The power generation system 90 is in communication with the airflow 62 flowing through the case 14. The power generation system 90 utilizes the airflow 62 to generate electricity for the light source 86, and/or for other electrical components within the merchandiser 10.

As illustrated, the power generation system 90 includes an air diffuser 94 coupled to the case 14 at a location adjacent the air inlet 78. More specifically, the illustrated air diffuser 94 is disposed between the air inlet 78 and the fan 82. In other constructions the air diffuser 94 can be located elsewhere along the path of the airflow 62. The air diffuser 94 includes an opening 96 (FIG. 3) that receives the airflow 62, and that distributes and directs the incoming air toward the fan 82 and evaporator 66. Generally, the air diffuser 94 can include different shapes and quantities of openings. In some constructions, the opening 96 is approximately equal to the length 98 although the opening 96 can be shorter than the overall length 98. The air diffuser 94 extends generally an entire length 98 of the merchandiser 10, although the air diffuser 94 can be shorter than the overall length 98. In some constructions, several air diffusers 94 can be placed in the merchandiser 10 side-by-side within the passageway 70. The air diffuser 94 is positionable within the merchandiser 10 such that the elongate opening 96 receives incoming airflow 62 from the product display area 42 and the air inlet 78.

With reference to FIGS. 2-5, the illustrated power generation system 90 also includes a generator 102 that is located adjacent the air diffuser 94. The generator 102 is in communication with the air diffuser 94 to utilize the kinetic energy of the airflow 62 moving through the air diffuser 94 to generate electrical energy. In some constructions, the generator 102 forms part of the air diffuser 94. The generator 102 includes one or more movable or rotatable blades 104 that are driven by the airflow 62 to generate alternating current ("AC") power. The illustrated blades 104 are elongate and are in communication with the opening 96 and are primarily or completely driven by the airflow 62.

The power generation system 90 also includes a transformer 106 that is located adjacent the generator 102 and that is in electrical communication with the generator 102. In some constructions, the transformer 106 forms part of one or both of the generator 102 and the air diffuser 94. Generally, the transformer 106 transforms the AC power generated by the generator 102 into direct current ("DC") power. In some constructions the transformer 106 can be a separate component disposed either inside or outside of the housing 92.

As illustrated by the dashed line 108 in FIG. 2, the power generation system 90 is in electrical communication with the light sources 86 to provide AC or DC power to the light sources 86, depending on whether the power requirements for the light sources 86. In some constructions, the power generation system 90 includes wiring extending from the transformer 106 along the rear wall 26 to the light source 86. The power generation system 90 also is in electrical communication with the fan 82, and optionally other electrical components of the case 14 to provide power to those components.

In some constructions, one or more of the air diffuser 94, the generator 102, and the transformer 106 can be placed in the air passageway 70 along the rear of the merchandiser 10. For example, in some constructions, the generator 102 and the transformer 106 can be positioned within the air passageway 70 along the rear wall 26, and as air flows through the air passageway 70, the air impacts the generator 102 and causes rotation of one or more components in the generator 102 to generate AC power that can be converted into DC power, if needed. Generally, the air diffuser 94, the generator 102, and the transformer 106 can be located anywhere in the merchandiser 10 as long as the air diffuser 94 is in airflow communication with the passageway 70.

Figure 4:
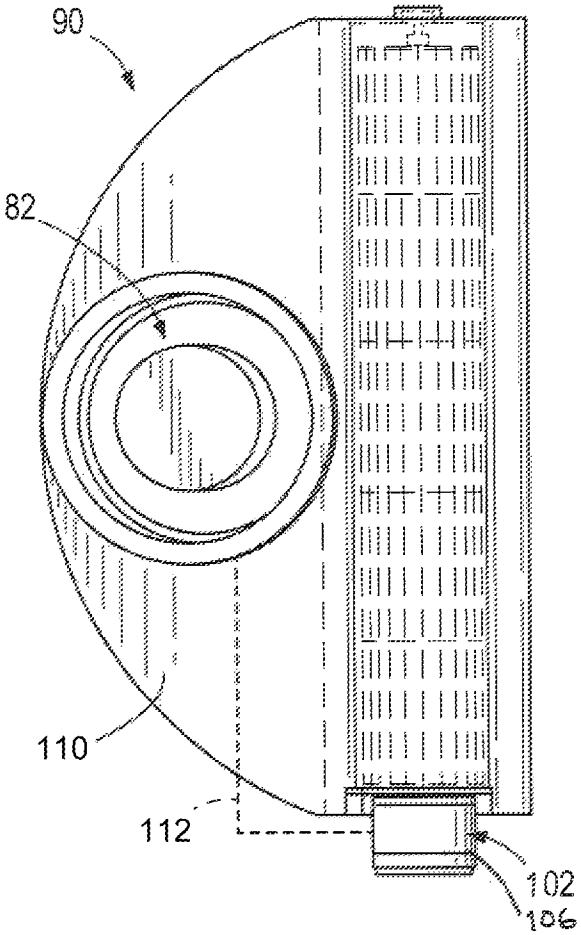
FIG. 4 is a schematic top plan view of the power generation system of FIG. 3.
Figure 3:
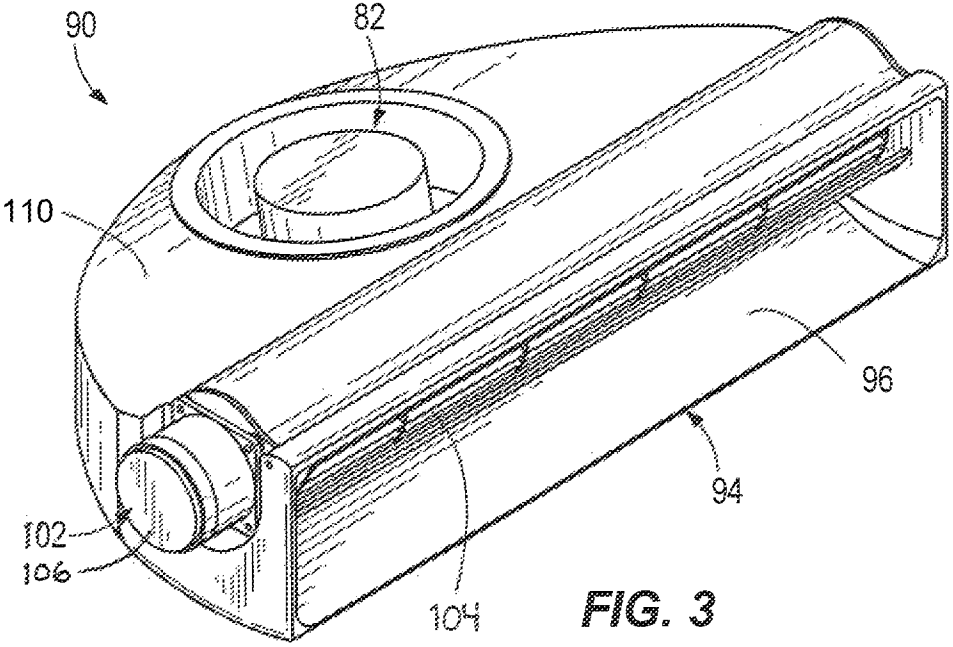
FIG. 3 is a front perspective view of a power generation system according to another construction of the invention.
Figure 5:
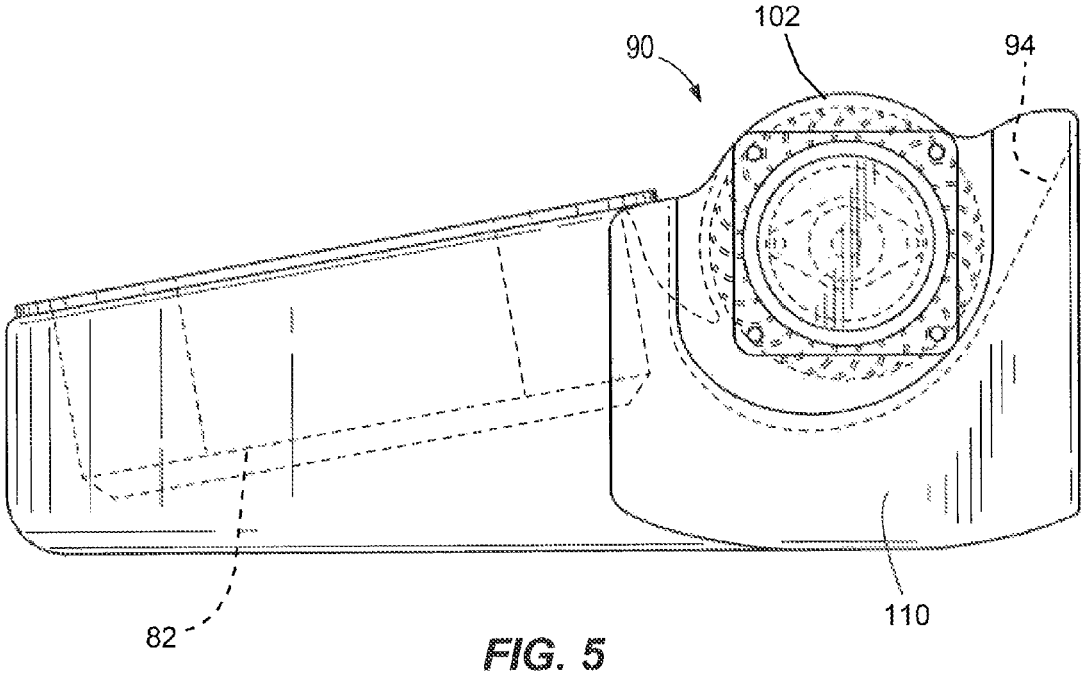
FIG. 5 is a side view of the power generation system of FIG. 3.

With reference to FIGS. 3-5, the illustrated power generation system 90 is a self-contained power generation system supported by a housing or shell 110. As shown, housing 110 supports the fan 82, the air diffuser 94, the generator 102, and the transformer 106, and can power at least one of the fan 82, the light sources 86, and other electrical components of the merchandiser 10. The fan 82 is disposed downstream of the opening 96. In some constructions, the power generation system 90 can be the only electrical power source for the fan 82 and/or the light sources 86 (e.g., after startup of the merchandiser 10). In some constructions, the power generation system 90 may only provide a portion of the electrical power to the fan 82 and the light sources 86, with the remainder of the power requirements met by other power sources (not shown).

As illustrated by dashed line 112 in FIG. 4, the generator 102 is directly—or indirectly via the transformer 106—is in electrical communication (e.g., via electrical wiring) with the fan 82 to provide AC or DC power to the fan 82. In some constructions, the wiring can extend partially outside of the housing 92.

In operation, the power generation system 90 captures energy from the airflow 62 within the merchandiser 10 and uses that energy to partially or completely power one or more electrical components in the merchandiser 10. The air diffuser 94 diffuses at least part of the airflow 62 (e.g., directs the airflow 62 in a desired pattern or direction) that is received from the air inlet 78. The air captured by the air diffuser 94 rotates the blades 104, which in turn converts the kinetic energy of the moving air into electrical energy in the form of AC power. The transformer 106 can be used to transform the AC power into DC power. The AC power and the DC power output from the power generation system 90 is based on airflow within the merchandiser 10 such that the merchandiser 10 does not need to rely only on an outside power source for operation.

Various features and advantages of the invention are set forth in the following claims.

The invention claimed is:

1. A refrigerated merchandiser comprising:

a case defining a product display area and including an air inlet located adjacent the product display area, an air outlet to discharge an airflow into the product display area, and a passageway fluidly connecting the air inlet to the air outlet to direct a conditioned airflow from the air outlet across the product display area and generally toward the air inlet;

a fan positioned within the passageway and configured to generate the airflow; and a power generation system including a housing disposed in the passageway and having a wall separate from the case, the power generation system further including an air diffuser supported by the housing and having an elongated opening configured to distribute and direct the airflow, the power generation system also including a power generation device positioned in the housing and in communication with the airflow to convert kinetic energy of the airflow into electrical energy to power the fan or another electrical component based on movement of the airflow.

2. The refrigerated merchandiser of claim 1, wherein the power generation device includes at least one of a generator and a transformer.

3. The refrigerated merchandiser of claim 2, wherein the case has an overall length, and wherein air diffuser extends approximately the entire overall length of the case.

4. The refrigerated merchandiser of claim 2, wherein the housing is coupled to a portion of the case defining the passageway.

5. The refrigerated merchandiser of claim 2, wherein the power generation device includes the generator, and wherein the generator is disposed adjacent the air diffuser downstream of an inlet of the air diffuser.

6. The refrigerated merchandiser of claim 1, wherein the power generation device includes a generator having a generator blade in communication with the airflow.

7. The refrigerated merchandiser of claim 1, wherein the power generation device includes a generator to convert kinetic energy from the airflow to alternating current (AC) power, and wherein the power generation system further includes a transformer in electrical communication with the generator to transform the AC electrical current into direct current (DC) power.

8. The refrigerated merchandiser of claim 1, further comprising a light source positioned to illuminate the product display area, and wherein the light source is powered only by electrical energy from the power generation system.

9. The refrigerated merchandiser of claim 1, wherein after startup, the fan is powered only by electrical energy from the power generation system.

10. A refrigerated merchandiser comprising:

a case defining a product display area and including an air inlet located adjacent the product display area, an air outlet to discharge an airflow into the product display area, and a passageway fluidly connecting the air inlet to the air outlet to direct a conditioned airflow from the air outlet across the product display area and generally toward the air inlet;

a light source coupled to the case and positioned to illuminate the product display area;

a fan positioned in the passageway to generate the airflow and to direct the airflow in a first direction; and a power generation system including a housing positioned in the passageway and coupled to the case within the passageway;

an air diffuser disposed in the housing and including an elongated opening which the airflow passes, the elongated opening having a length extending across the passageway; and a generator disposed in the housing and including a blade positioned adjacent and extending the length of the elongated opening, the generator in communication with the airflow to convert kinetic energy of the airflow into electrical energy to at least partially power one or both of the light source and the fan based on movement of the airflow within the passageway, wherein the air diffuser is configured to direct the airflow in a second direction different from the first direction.

11. The refrigerated merchandiser of claim 10, wherein the fan is disposed in the housing downstream of the opening.

12. The refrigerated merchandiser of claim 10, wherein after startup, the fan is powered only by electrical energy from the generator.

13. The refrigerated merchandiser of claim 10, wherein the power generation system further includes a transformer operatively coupled to the generator to transform alternating current (AC) power from the generator into direct current (DC) power.

14. The refrigerated merchandiser of claim 10, wherein the power generation system provides power to the light source and the fan.

15. The refrigerated merchandiser of claim 10, wherein the blade has an axis of rotation that is perpendicular to direction of airflow passing through the elongated opening.

16. The refrigerated merchandiser of claim 10, wherein the fan is disposed in and supported by the housing separate from the case.

17. A method of powering an electrical component in a refrigerated merchandiser, the method comprising:

generating an airflow with a fan;

directing the airflow through a passageway within the merchandiser, the passageway communicating air to an air outlet;

discharging the airflow through the air outlet to condition a product display area of the merchandiser;

directing the airflow through an elongated opening of a generator and distributing the airflow through the passageway, the generator disposed in a housing supported in the passageway and having a wall separate from the merchandiser;

converting kinetic energy of the airflow into electrical energy in response to air passing through the generator; and at least partially powering an electrical component of the merchandiser via the electrical energy generated based on movement of the airflow.

18. The method of claim 17, further comprising:

generating alternating current (AC) power from movement of the airflow; and transforming the AC power into direct current (DC) power.

19. The method of claim 17, further comprising diffusing the airflow prior to directing the airflow through the generator.

* * * * *